US006364584B1

(12) United States Patent
Taylor

(10) Patent No.: US 6,364,584 B1
(45) Date of Patent: Apr. 2, 2002

(54) ACCESS BAR FOR A SHIPPING CONTAINER

(76) Inventor: Patrick Asher Taylor, 16792 Talisman La., Apt. #209, Huntington Beach, CA (US) 92649

( * ) Notice: Subject to any disclaimer, the term of this patent is extended or adjusted under 35 U.S.C. 154(b) by 0 days.

(21) Appl. No.: 09/653,480

(22) Filed: Sep. 1, 2000

(51) Int. Cl.[7] ..... B60P 7/06

(52) U.S. Cl. ..... 410/94; 410/35; 410/52; 410/85; 410/39; 410/40; 410/41; 410/80; 410/121; 410/71

(58) Field of Search ..... 410/129, 35, 39, 410/40, 41, 52, 54, 80, 99, 121, 71, 73, 153, 155, 94, 82; 220/1.5, 4.27; 280/406.1; 206/453, 586; 248/346, 351; 24/287

(56) References Cited

U.S. PATENT DOCUMENTS 1,675,701 A * 7/1928 Fitch ..... 410/71
1,897,138 A * 2/1933 North ..... 410/99
2,461,767 A * 2/1949 Peyton ..... 410/121
3,321,162 A * 5/1967 Connerat ..... 410/73
3,854,423 A * 12/1974 Bridge ..... 410/54
3,908,850 A * 9/1975 Jureit et al.
4,091,741 A * 5/1978 Hartkorn ..... 410/94
4,092,933 A * 6/1978 Charlton ..... 410/94
4,265,184 A * 5/1981 Cox ..... 206/453
4,266,820 A * 5/1981 Whaley et al. ..... 410/82 X
4,354,781 A * 10/1982 Roberts ..... 410/77
4,537,540 A * 8/1985 Boughton ..... 410/82
4,624,188 A * 11/1986 Kaleta ..... 410/94 X
4,759,294 A * 7/1988 Schuller et al. ..... 410/71 X
4,792,269 A * 12/1988 Engle ..... 410/54 X
4,854,791 A * 8/1989 Brown ..... 410/52
4,883,393 A * 11/1989 Acquaro ..... 410/52
5,092,250 A * 3/1992 Halliar ..... 410/52 X
6,089,804 A * 7/2000 Bartlelt ..... 410/121 X
6,098,804 A * 8/2000 Bartholomew ..... 206/453 X

* cited by examiner

*Primary Examiner*—Stephen T. Gordon
(74) *Attorney, Agent, or Firm*—Gene Scott-Patent Law & Venture Group

(57) ABSTRACT

A combination shipping container, shipping container locking device and a door blocking apparatus inhibits access to the interior of the shipping container while it is being shipped. The blocking apparatus comprises a pair of legs joined to form a generally L-shaped, elongate member, wherein one of the legs provides a pair of spaced apart apertures, with each of the apertures fitted over the container locking device and locked in place adjacent to a set of closed doors of the shipping container. The other of the legs of the elongate member extends upwardly from the first leg in a position for blocking the doors of the shipping container from being opened.

6 Claims, 4 Drawing Sheets

ACCESS BAR FOR A SHIPPING CONTAINER

BACKGROUND OF THE INVENTION

1. Field of the Invention

This invention relates generally to devices for barring entry to a spaced accessed by doors and more particularly to an apparatus for barring access to a shipping container.

2. Description of Related Art

Shipping containers are used globally to move materials by ship, truck and train. These containers are provided in various lengths to fulfill a broad range of shipping needs. Access to the interior of these containers is gained through doors set in one end of the container and which open outwardly, each of the doors hinging at the outside edge of the door. As shown in FIGS. 2–4 of this disclosure, the universal means employed for inhibiting access to these shipping containers is a set of two vertical bars placed in front of each door. These bars may be moved vertically to be placed into dogs and then may be locked with an type of pad lock. Since pad locks are easily defeated by a saw, torch or other burglary tool, or even by a key in the possession of those who are not authorized, a means for further barring access to storage containers is needed.

The prior art teaches the use of padlocked bars for inhibiting access to a storage container. However, the prior art does not teach a positive means for such, that is, a means that will absolutely prevent theft from storage containers when they are in transit, and yet be easily removed when the container is ready to be legitimately accessed. The present invention fulfills these needs and provides further related advantages as described in the following summary.

SUMMARY OF THE INVENTION

The present invention teaches certain benefits in construction and use which give rise to the objectives described below.

A combination shipping container, shipping container locking device and a door blocking apparatus inhibits access to the interior of the shipping container. The blocking apparatus comprises a pair of legs joined to form a generally L-shaped, elongate member, wherein one of the legs provides a pair of spaced apart apertures, with each of the apertures fitted over the container locking device and locked in place adjacent to a set of closed doors of the shipping container. The other of the legs of the elongate member extends upwardly from the first leg in a position for blocking the doors of the shipping container from being opened.

A primary objective of the present invention is to provide an apparatus and method of use of such apparatus that provides advantages not taught by the prior art.

Another objective is to provide such an invention capable of being constructed of light weight material.

A further objective is to provide such an invention capable of blocking access to a shipping container without the necessity of providing a separate attachment device.

A still further objective is to provide such an invention capable of being easily installed and removed from the shipping container.

A final objective is to provide such an invention that fulfills these objectives in a manner that is competitive or exceeds the capabilities of the prior art.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
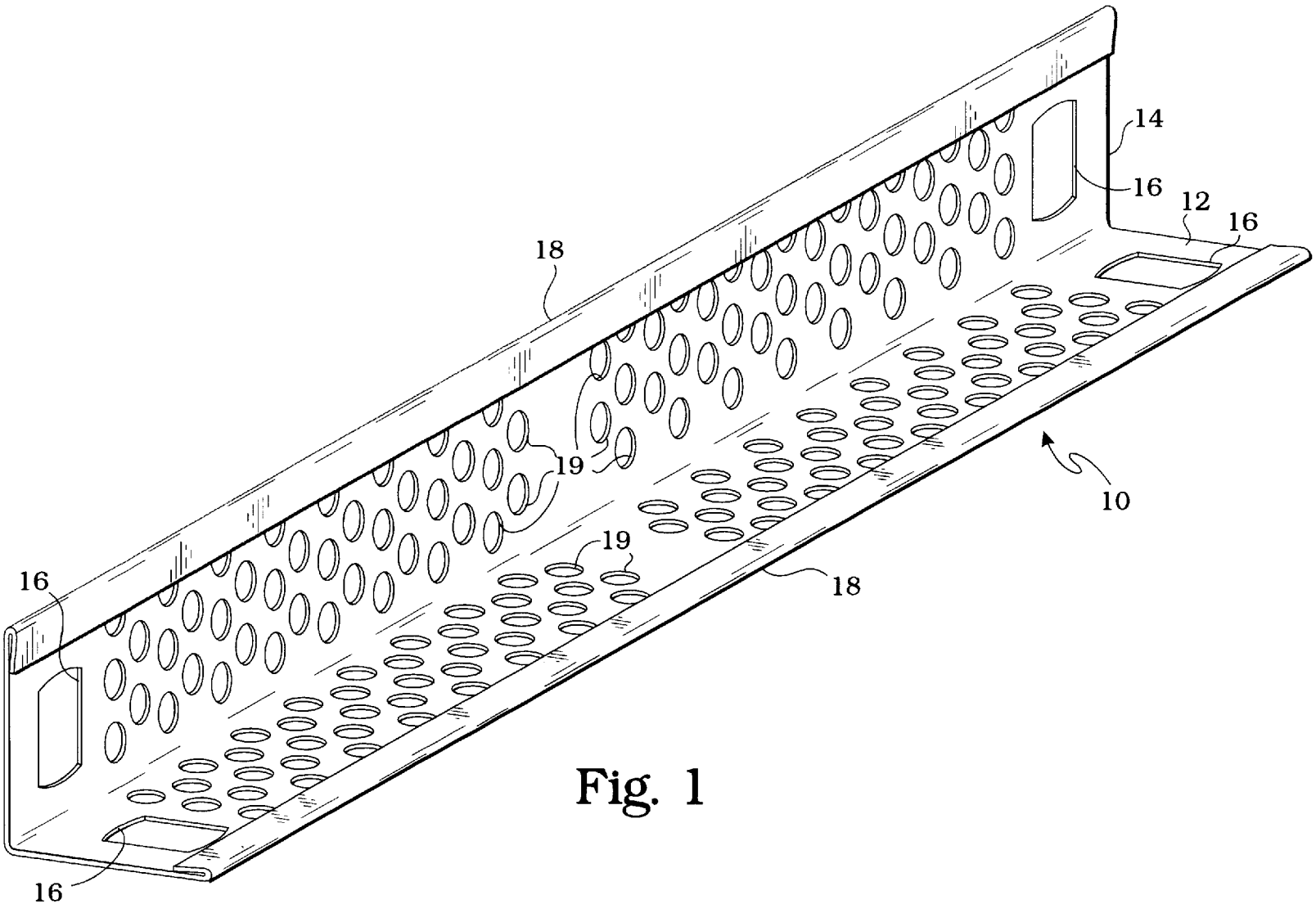
FIG. 1 is a perspective view of the preferred embodiment of the invention.

The above described drawing figures illustrate the invention, an apparatus 10 for barring access to a shipping container 20. Access is barred by placing a plate in front of the access doors 22 of the container 20 thereby blocking the doors 22 of a shipping container 20 so that they cannot be opened. The invention apparatus 10 comprises a pair of legs 12, 14 joined to form a generally L-shaped, elongate member which will be also referred to using numeral 10, wherein at least one of the legs and preferably both provides a pair of spaced apart apertures 16, with each of the apertures 16 adapted for fitting over a container lock 30 so that the elongate member 10 is locked in place adjacent to the doors 22 of the shipping container 20. The other of the legs 14 of the elongate member extends upwardly from the one of the legs 12 in a position for blocking access to the doors 22 of the shipping container 20.

Preferably the apparatus 10 is made of high strength steel sheet material and provides a terminal edge 18 running parallel to the longitudinal axis of the elongate member, the terminal edge 18 preferably formed by bending the sheet material back onto itself, as clearly shown in FIG. 1, whereby the at least one of the legs 12, 14 is thereby made rigid and the terminal edge 18 is made smooth. In the preferred embodiment at least one of the legs provides a plurality of lightening holes 19 so that the elongate member is easily moved and placed into operation by one individual.

Figure 2:
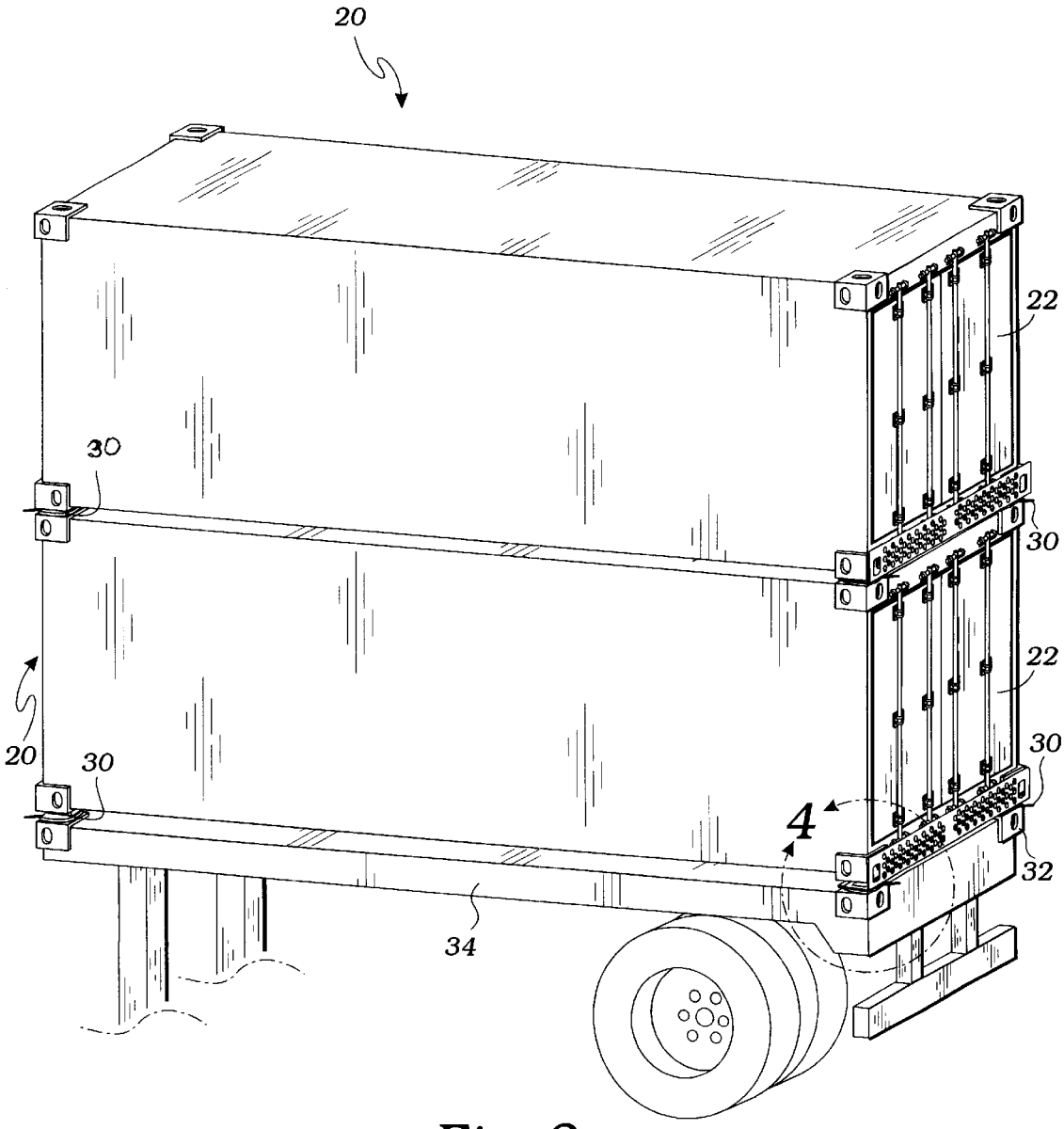
FIG. 2 is perspective view thereof showing the use of the invention in combination with a shipping container and a locking device.
Figure 3:
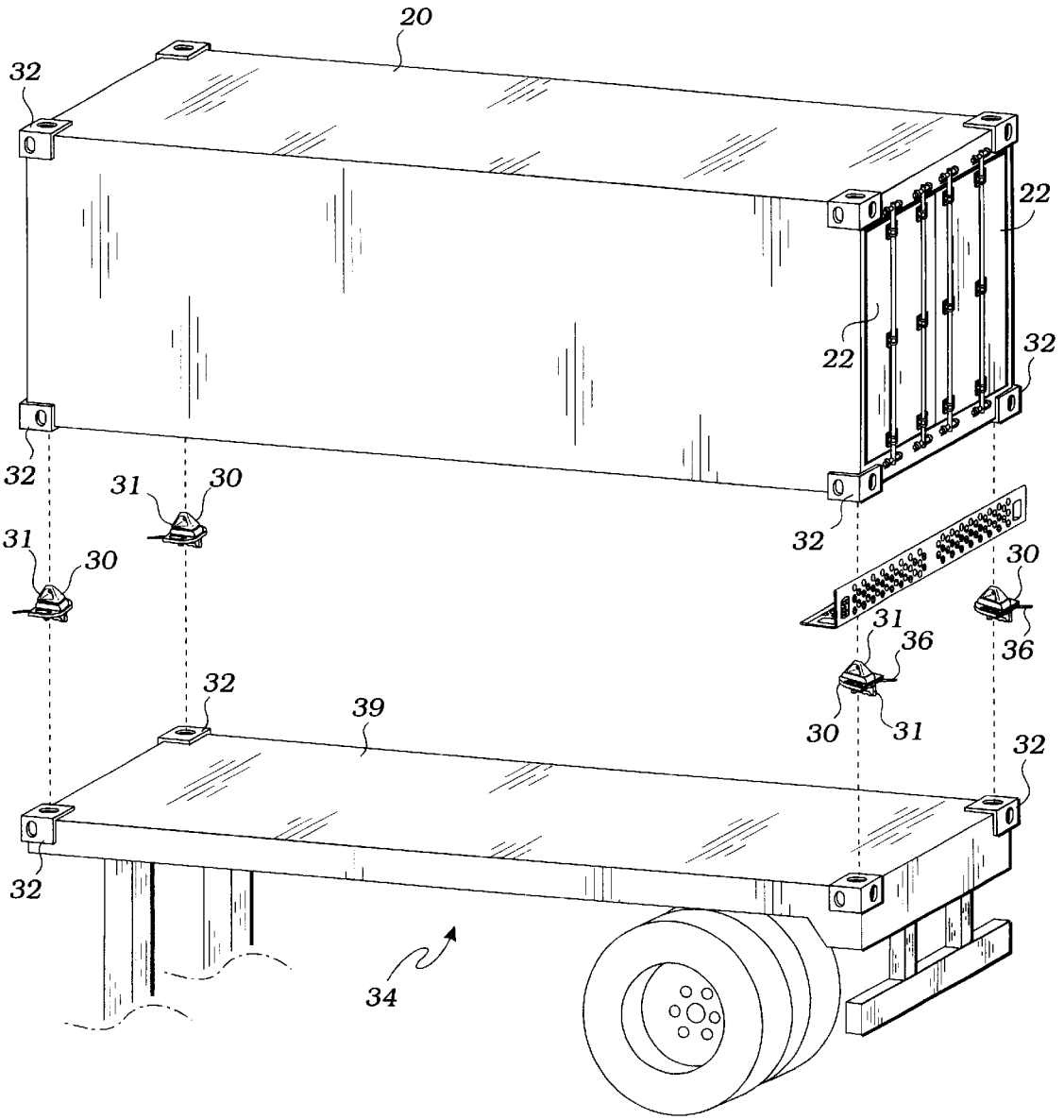
FIG. 3 is an exploded perspective view thereof.
Figure 4:
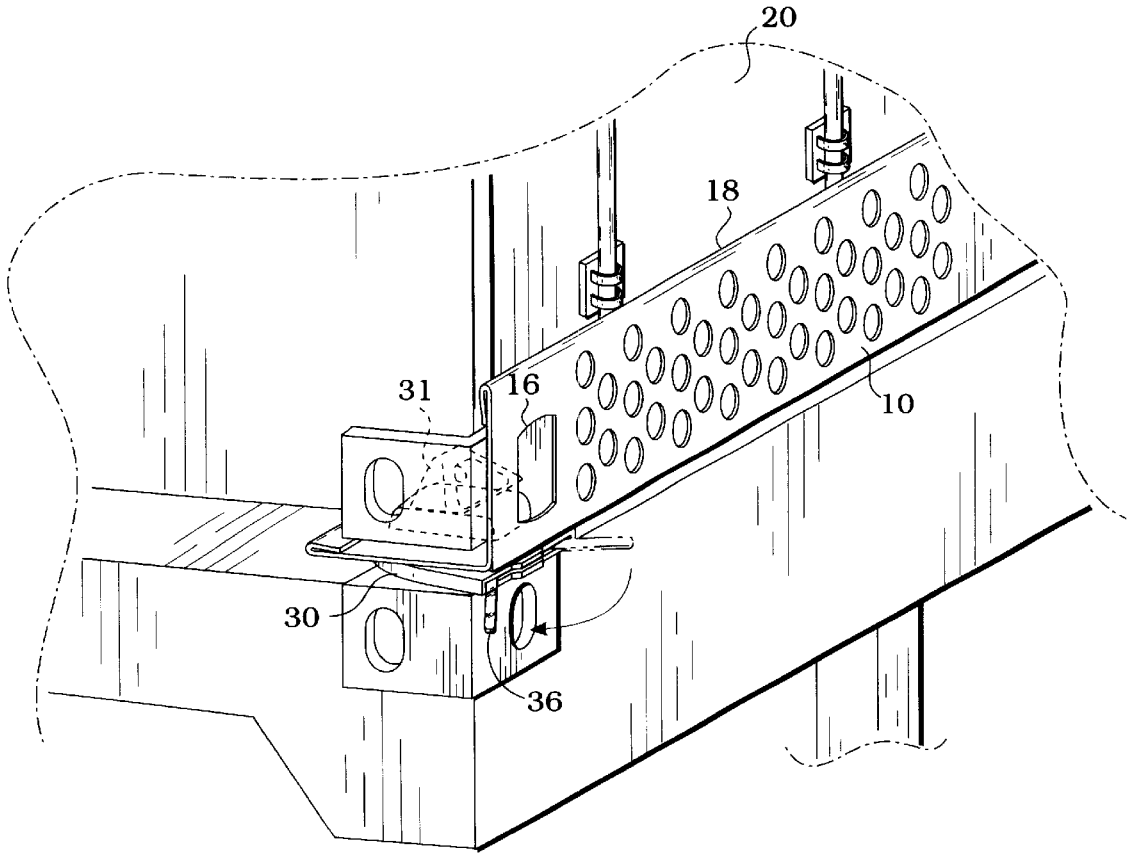
FIG. 4 is a close-up view thereof taken along line 4—4 of FIG. 2.

The preferred embodiment is a combination of the shipping container 20, shipping container locking means 30 and the blocking apparatus 10 for inhibiting access to the shipping container 20. The shipping container locking means 30 is a well known fixture used for locking-down the container 20 to the bed 39 of a truck, as shown in FIG. 3, to a second shipping container positioned below the one being mounted, as shown in FIG. 2, to a flatbed of a railway car or to a deck of a cargo ship. Such a locking means 30 provides an upper and a lower locking cleats 31 rotationally mounted onto a base. The lower cleat 31 mounts in an elongated hole of a mounting bracket 32 at each corner of the flatbed 39. This is shown in FIG. 3, whereby the four locking means 30 are assembled into the mounting brackets 32 of the flatbed truck trailer 34. A handle 36 allows the locking means 30 to be anchored in the mounting brackets 32. However, the elongate member 10 is placed over the upwardly directed locking cleats 31 with the cleats penetrating the holes 16, and the container 20 is placed with its mounting brackets 32 over the upwardly directed locking cleats 31 at each of four comers of the container 20, prior to the cleats 31 being rotated into the engaged position. Clearly, it should be seen that the shipping container 20 holds the elongate member 10 in place by its weight, which may be many tons. Even if the handle 36 is moved to the unengaged position, the weight of the shipping container prevents removal of the elongate member 10. As described above, the blocking apparatus 10 comprises a pair of legs 12, 14 joined to form the generally L-shaped, elongate member 10, wherein at least one of the legs provides the pair of spaced apart apertures 16. With each of the apertures 16 fitted over the container locking means 30 and locked in place adjacent to a set of closed doors 22 of the shipping container 20, the other of the legs 14 of the elongate member 10 extends upwardly, as best seen in FIG. 4, from the one of the legs 12 in a position for blocking the doors 22 of the shipping container 10 from being opened.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for blocking access to the doors of a shipping container comprising in combination: a pair of spaced-apart shipping container retention means upon which the shipping container rests, and a pair of legs joined to form a generally L-shaped, elongate member; one of the legs providing a pair of spaced-apart apertures receiving the shipping container retention means thereby locking the elongate member in a position for blocking the doors of the shipping container.

2. The apparatus of claim 1 wherein at least one of the legs is made of a sheet material and provides a terminal edge running parallel to the longitudinal axis of the elongate member, the terminal edge formed by bending the sheet material back onto itself whereby the at least one of the legs is made rigid and the terminal edge made smooth.

3. The apparatus of claim 2 wherein at least one of the legs provides a plurality of lightening holes.

4. A combination shipping container, shipping container locking means and a blocking apparatus for inhibiting access to a shipping container, the blocking apparatus comprising a pair of legs joined to form a generally L-shaped, elongate member, wherein at least one of the legs provides a pair of spaced apart apertures, with each of the apertures fitted over the container locking means and locked in place adjacent a set of closed doors of the shipping container, the other of the legs of the elongate member extending upwardly from the one of the legs in a position for blocking the doors of the shipping container from being opened.

5. The apparatus of claim 4 wherein at least one of the legs is made of a sheet material and provides a terminal edge running parallel to the longitudinal axis of the elongate member, the terminal edge formed by bending the sheet material back onto itself whereby the at least one of the legs is made rigid and the terminal edge made smooth.

6. The apparatus of claim 5 wherein at least one of the legs provides a plurality of lightening holes.

* * * * *